US006382450B1

(12) United States Patent
De Rosa et al.

(10) Patent No.: US 6,382,450 B1
(45) Date of Patent: May 7, 2002

(54) PACKAGING DEVICE EQUIPPED WITH A SYSTEM FOR RELATIVE POSITIONING

(75) Inventors: Daniel De Rosa, Louviers; Paulo Do Rosario, Neuilly Plaisance, both of (FR)

(73) Assignees: G. Pivaudran Developpements, Taverny (FR); I. Pack, Louviers (FR)

( * ) Notice: Subject to any disclaimer, the term of this patent is extended or adjusted under 35 U.S.C. 154(b) by 0 days.

(21) Appl. No.: 09/694,318

(22) Filed: Oct. 24, 2000

(30) Foreign Application Priority Data

Oct. 25, 1999 (FR) ..... 99 13258

(51) Int. Cl.[7] ..... B65D 51/10
(52) U.S. Cl. ..... 220/230; 206/818
(58) Field of Search ..... 220/230; 206/818; 179/3 T; 138/89; 150/40

(56) References Cited

U.S. PATENT DOCUMENTS 3,716,091 A * 2/1973 Gaines ..... 150/40
4,110,552 A * 8/1978 Lombrdi ..... 174/35
5,392,816 A * 2/1995 Hangenberg et al. ..... 138/98
5,435,112 A 7/1995 Goyet

FOREIGN PATENT DOCUMENTS

| | | |
|---|---|---|
| DE | 11 90 349 | 4/1965 |
| FR | 1 046 488 | 12/1953 |
| FR | 2 680 761 | 3/1993 |
| FR | 2 731 985 | 9/1996 |
| JP | 1-167055 * | 6/1989 |

* cited by examiner

*Primary Examiner*—Lee Young
*Assistant Examiner*—Lien Ngo
(74) *Attorney, Agent, or Firm*—Young & Thompson

(57) ABSTRACT

Packaging device for a fluid product, comprising a magnetic system for automatic relative positioning upon closure, comprising a first magnetic means (16) carried by the cap (3) and a second magnetic means (11) carried by the container (1), the first and second magnetic means facing one another when the container is in the closed position, the location of the poles of each magnetic means being determined with respect to the location of the external ornamental features, so as to automatically obtain the predetermined relative positioning of said external ornamental features upon closure of the container.

13 Claims, 2 Drawing Sheets

PACKAGING DEVICE EQUIPPED WITH A SYSTEM FOR RELATIVE POSITIONING

BACKGROUND OF THE INVENTION

The present invention relates to a packaging device for a fluid, liquid or pasty product, for example a scent bottle.

In general, a device such as this comprises a container intended to contain the product, the neck of the container being equipped with a head for dispensing the product, and a cap is intended to at least partially cap said head. The cap, like the container, may comprise ornamental external features, for example inscriptions, marks or signs, which need to be aligned or positioned with respect to each other. The cap like the container may also have asymmetric or polygonal shapes which need to be aligned with each other when the container is closed.

In order to make sure that the external ornamental feature of the cap is correctly aligned with respect to the external ornamental feature of the container, it is possible to provide a polarizing means to allow the container to be closed by the cap in a predetermined relative position that ensures the alignment of the external ornamental features of the cap with respect to the container. However, a mechanical system such as this for providing relative positioning may lead to fumbling on the part of the user, before he or she finds the relative position allowed for the container to be closed by the cap. Furthermore, a mechanical system such as this complicates the system used to hold the cap on the container in the closed position.

SUMMARY OF THE INVENTION

The object of the invention is to eliminate the aforementioned drawbacks and to propose a packaging device which has a system for the relative positioning of the external ornamental features of the cap and of the container and which is simple and effective to use while at the same time allowing the container to be closed correctly by the cap.

To this end, the subject of the invention is a packaging device for a fluid, liquid or pasty product, comprising a container intended to contain said product, the neck of the container being equipped with a head for dispensing the product, and a cap intended to at least partially cap said head, the device comprising a system for the relative positioning of at least one first external ornamental feature carried by the cap with respect to at least one second external ornamental feature carried by the container in a predetermined relative position, characterized in that said system for relative positioning is a magnetic system for automatic relative positioning upon closure, said system comprising a first magnetic means which is permanently magnetized carried by the cap and a second magnetic means which is permanently magnetized carried by the container in a location such that the aforementioned first and second magnetic means face each other when the container is in the closed position, the first magnetic means having at least two opposed magnetic poles (S, N) on its face facing toward the second magnetic means, whose face facing it has complementing magnetic poles (N, S), the location of the poles of each magnetic means being determined with respect to the location of the external ornamental features so as to automatically obtain the predetermined relative positioning of said external ornamental features upon closing the container.

According to a particular feature of the invention, the container comprises a part surrounding its neck, said part having an annular housing capable of containing the aforementioned second magnetic means, and the cap also comprises an annular housing capable of containing, at its base, the aforementioned first magnetic means so that upon closure, the first magnetic means circumscribes the dispensing head and sits atop the second magnetic means with a small gap.

Advantageously, the cap and the container comprise complementing means which serve to guide the cap on the neck of the container upon closure and which allow the cap to be rotated axially with respect to the container under the effect of the magnetic forces of attraction and/or repulsion, regardless of the external shape of the cap or of the container. As a preference, the cap 3 has a circular cylindrical internal surface which is a sliding fit, upon closure, on a circular cylindrical portion of the part surrounding the dispensing head of the device.

In a first alternative form, each magnetic means consists of a multipole annular permanent magnet, each magnet being secured in its respective housing for example by bonding or wedging. In another alternative form, each magnetic means consists of a number of small permanent magnets, for example in the form of pegs, overmolded with a plastic jacket of annular overall shape, each annular jacket being fixed into its respective housing for example by bonding or wedging.

Advantageously, at least one of the first and/or second external ornamental features consists of an inscription, a mark or a sign carried by the cap or the container.

According to yet another feature, when the cap and/or the container has/have an external surface which does/do not exhibit symmetry of revolution, at least one of the first and second external ornamental features consists of the actual shape of this surface. In this case, it can be contrived that when the cap and a part surrounding the neck of the container have the same polygonal cross section, the first and second external ornamental features consist of the edges of said polygons, so that the aforementioned magnetic system for relative positioning automatically aligns the edges of the cap with those of said part.

The invention will be better understood and other objects, details, features and advantages of the invention will become more clearly apparent in the course of the detailed explanatory description which will follow of a number of alternative forms of the invention which are given merely by way of non-limiting illustration with reference to the appended diagrammatic drawing.

DETAILED DESCRIPTION OF THE PREFERRED EMBODIMENTS

Figure 1:
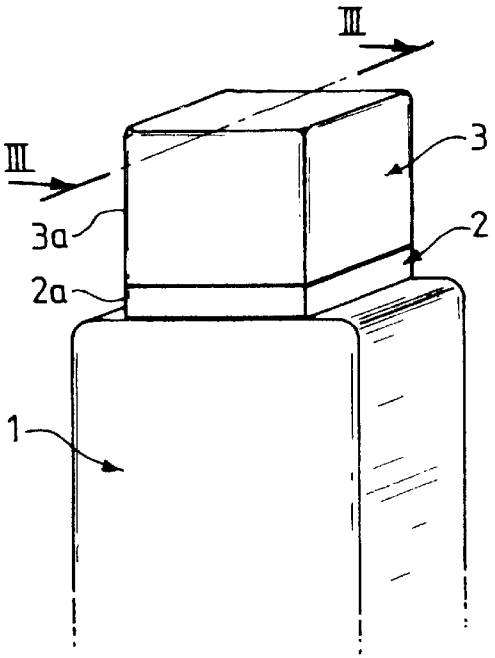
FIG. 1 is a partial and perspective view of a packaging device in which the cap and the base of the band on the container are of square cross section.
Figure 6:
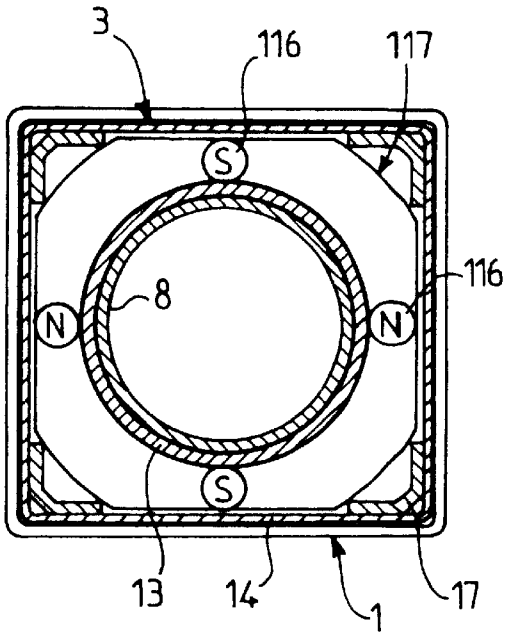
FIG. 6 is a view similar to FIG. 4 but according to an alternative form of the invention.

FIG. 1 shows a container consisting of a bottle 1 of rectangular cross section, the upper part of which is fitted with a band 2, the base of which has a square cross section, a cap 3 of the same cross section as said base fitting atop the latter. The edges 2*a* of the band 2 are aligned with the edges 3*a* of the cap 3.

Figure 2:
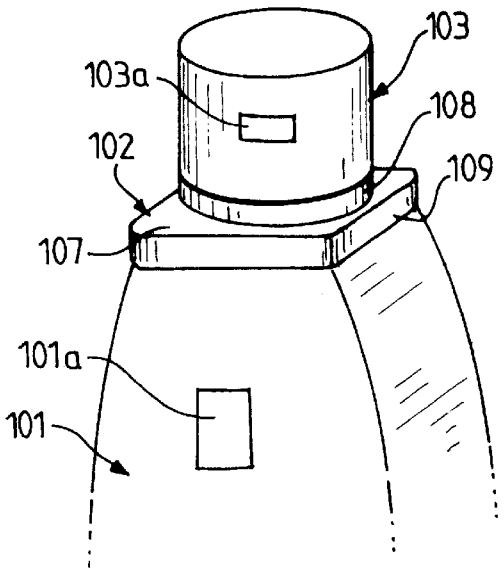
FIG. 2 is a view similar to FIG. 1, but depicting a cap of circular cross section.

In FIG. 2, the container 101 consists of a bottle of a shape that widens toward the bottom, the upper part of which is equipped with a band 102 surmounted by a circular cylindrical cap 103. The base 109 of the band 102 has a rectangular cross section and is extended at its center by a circular cylindrical portion 108 which has the same outside diameter as the cap 103. The cap 103 bears an inscription 103*a* on its external lateral cylindrical face and the bottle 101 bears an inscription 101*a* on one of its external lateral faces. The cap 103 is positioned with respect to the container 101 in such a way that the inscriptions 101*a* and 103*a* are roughly aligned in the heightwise direction.

Figure 3:
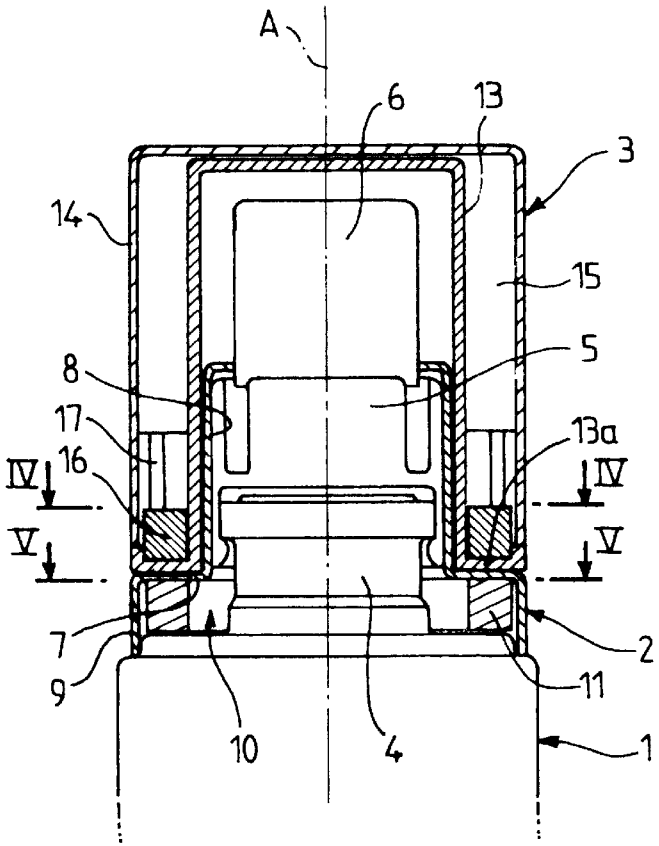
FIG. 3 is a view in axial part section of a packaging device according to the invention, in the direction of arrows III—III of FIG. 1.

Referring more particularly to FIG. 3, it may be seen that the container 1 at its top has an upwardly projecting neck 4 to which a pump body 5 is fastened in a known way, this pump body at its top being equipped with a push-button 6 to form the dispensing head for dispensing the product contained in the container 1.

The aforementioned band 2 serves to conceal the pump body whilst the cap 3 has been removed. Starting from its base 9, which is of square cross section, the band 2 has an annular shoulder 7 extending radially toward the axis A of the container and an upper circular cylindrical portion 8 of smaller cross section which envelopes the aforementioned pump body 5. The metal band 2 is generally bonded to the container 1 and to the pump body 5.

Figure 5:
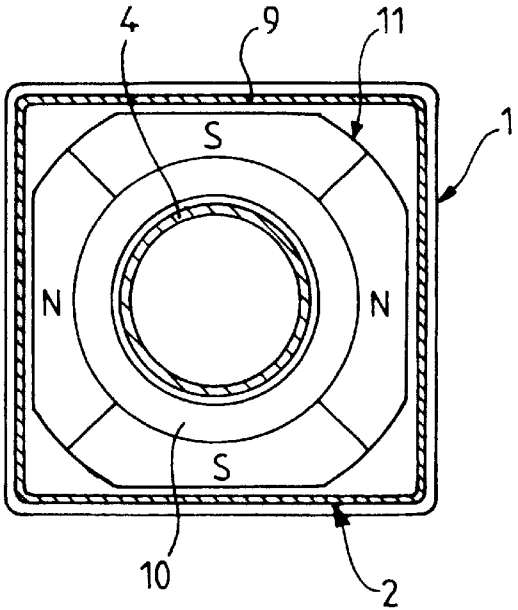
FIG. 5 is a view in cross section on V—V of FIG. 3.

The upper part of the container 1 which surrounds the neck 4 defines, with the base 9 of the band 2 and the aforementioned annular shoulder 7, an interior annular housing 10 in which an annular permanent magnet 11 is housed. By referring to FIG. 5 it may be seen that the magnet 11, on its upper face, has two diametrically opposed pairs of polar zones, the polar zones of each pair having the same magnetization, north (N) or south (S), and the polarity of each pair being opposed. Thus, the polar zones N and S alternate regularly about the axis A of the container. In particular, each polar zone is located roughly along one side of the square cross section base 9 of the band 2.

Figure 4:
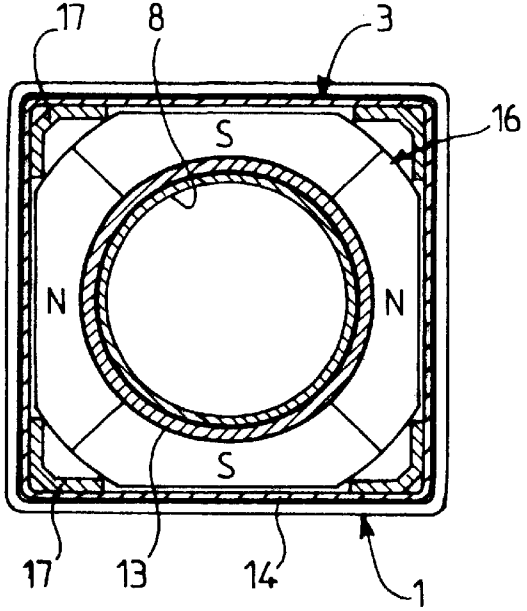
FIG. 4 is a view in cross section on IV—IV of FIG. 3, the dispensing head and the neck having been omitted for reasons of clarity.

Returning now to FIG. 3, it may be seen that the cap 3 consists of two metal parts fitted one inside the other. The inner metal part 13 has an internal circular cylindrical surface which, at its lower part, is extended by an annular flange 13*a,* the external periphery of which has a square profile and serves as a support for a second metal part 14 of square cross section which caps the first part 13. Defined between the two parts 13 and 14 is an annular space 15 in which another annular permanent magnet 16, secured to the flange 13*a* of the internal part 13, is housed. For example, the permanent magnet 16 is fixed into the housing 15 by wedging, using four wedges 17. The permanent magnet 16 may be identical to the permanent element [sic] 11. However, it is positioned in the cap 3 in such a way that its polar zones on the face facing toward the container have the opposite magnetization to that of the face of the permanent magnet 11 that faces it when the cap is in its predetermined relative position on the container. Indeed, FIG. 4 shows that face of the magnet 16 which faces away from the container, which means that vertically below a polar zone S visible in FIG. 4 there corresponds a polar zone N on the side facing toward the container. Of course, the cap 3 is made in two parts 13, 14 so that the permanent magnet 16 can be fitted inside. Here too, the polar zones N and S of the permanent magnet 16 are located roughly along one face of the cap 3.

As an alternative, as depicted in FIG. 3, the permanent magnet 16 could be replaced with a number of permanently magnetized pegs 116 which correspond respectively to each polar zone of the aforementioned permanent magnet 16. These pegs 116 may be overmolded in a plastic jacket 117 before they are mounted in the cap 3. Similarly, although this has not been depicted, the annular permanent magnet 11 may also be replaced by a number of permanently magnetized pegs overmolded in a plastic jacket.

The way in which the invention works will now be briefly described. When the user has removed the cap 3 from the container 1 and dispensed some of the product contained in the container 1 to the outside, via the dispensing head 5, 6, the cap 3 needs to be put back on to avoid any inadvertent and accidental pressure on the push-button 6 actuating the pump of the device.

In the case of FIG. 1, the user can put the cap 3 back on to the band 2 without worrying about the alignment of the respective edges. Upon closure, the cap 3 is guided by the internal circular cylindrical surface of its part 13, which slides along the external circular cylindrical surface of the portion 8 of the band 2. When the base 13*a* of the cap 3 is close enough to the shoulder 9 of the band 2, the magnetic fields generated by the permanent fields 11 and 16 interact. In an extreme case, the polar zones of each magnet which are facing each other are of the same polarity and the cap 3 is then automatically made to undergo a turning movement, because of the magnetic repulsion, which turning movement is accentuated by the attraction of the polar zones of opposed polarities of the two magnets, which gradually come into superposition as the cap 3 turns. In another extreme case, the cap 3 is put in place with the polar zones of the two magnets which have opposed polarities facing each other, which means that no rotation is brought about. When all the polar zones of the two magnets are facing a polar zone of opposed polarity, the cap 3 is in a stable position with respect to the container 1, this stable position having been predetermined in such a way that the edges 3*a* of the cap 3 are aligned with the edges 2*a* of the base 2. At the same time, the magnets 11, 16 hold the cap 3 on the container 1. It is therefore not necessary to provide additional means of attachment.

In the case of FIG. 2, the operation is the same except that in this instance it is the inscriptions 101*a* and 103*a* which are aligned by the magnets, rather than the aforementioned edges 2*a* and 3*a*.

Of course, the number of poles or polar zones on each magnet can be altered without departing from the scope of the invention. For example, it is possible to provide simply two polar zones of opposed polarities diametrically opposed on the face of the same magnet. In the case of several permanently magnetized pegs, it is possible to provide an even or odd number of pegs.

Of course, the more the polar zones are spread out around the periphery of the cap or of the container, the more quickly the automatic positioning system will operate.

By way of example, the permanent magnets may be made of neodymium-iron-boron.

Although the invention has been described in conjunction with a number of alternative forms, it is quite obvious that it is not in any way restricted thereto and that it encompasses all technical equivalents of the means described and combinations thereof where these fall within the scope of the invention.

What is claimed is:

1. Packaging device for a fluid product, liquid product or pasty product, comprising:

a container intended to contain said product, a neck of the container being equipped with a head for dispensing the product;

a cap intended to at least partially cap said head;

a system for relative positioning of at least one first external ornamental feature carried by the cap with respect to at least one second external ornamental feature carried by the container in a predetermined relative position, said system for relative positioning being a magnetic system for automatic relative positioning upon closure and comprising a first and a second permanently magnetized magnetic means for generating interacting magnetic fields, said first magnetic means being carried by the cap and said second magnetic means being carried by the container in a location such that the first and second magnetic means face each other when the container is in the closed position, the first magnetic means having at least two opposed magnetic poles on a first face facing toward the second magnetic means, the second magnetic means having a second face facing said first face and having complementing magnetic poles, a location of the poles of each said first and second magnetic means being determined with respect to a location of the external ornamental features so as to automatically obtain the predetermined relative positioning of said external ornamental features upon closing the container;

the container comprising a part surrounding the neck, said part having a first annular housing capable of containing the second magnetic means, and the cap comprising a second annular housing capable of containing, at a base of the cap, the first magnetic means so that upon closure, the first magnetic means circumscribes the head for dispensing and sits atop the second magnetic means with a small gap.

2. Device according to claim 1, wherein the cap and the container comprise complementing means for guiding the cap on the neck of the container upon closure and which allow the cap to be rotated axially with respect to the container under the effect of at least one of a magnetic force of attraction and a magnetic force of repulsion, regardless of the external shape of the cap or of the container.

3. Device according to claim 2, wherein the cap has a circular cylindrical internal surface which is a sliding fit, upon closure, on a circular cylindrical portion of the part surrounding the dispensing head of the device.

4. Device according to claim 1, wherein each said first and second magnetic means consists of a multipole annular permanent magnet, each said magnet being secured in a respective one of said first and second housings.

5. Device according to claim 1, wherein each said first and second magnetic means consists of a number of small permanent magnets overmolded with a plastic jacket of annular overall shape, each annular jacket being fixed into a respective one of said first and second housings.

6. Device according to claim 1, wherein at least one of the first and second external ornamental features consists of one of an inscription, a mark and a sign carried by one of the cap and the container.

7. Device according to claim 1, wherein at least one of the cap and the container has an external surface which does not exhibit symmetry of revolution, at least one of the first and second external ornamental features consists of an actual shape of said external surface.

8. Device according to claim 7, wherein the cap and said part surrounding the neck have a same polygonal cross section, the first and second external ornamental features consisting of edges of said polygon, so that the system for relative positioning automatically aligns edges of the cap with edges of said part surrounding the neck.

9. Device according to claim 4, wherein each said magnet is secured by bonding in a respective one of said first and second housings.

10. Device according to claim 4, wherein each said magnet is secured by wedging in a respective one of said first and second housings.

11. Device according to claim 5, wherein the number of small permanent magnets are in the form of pegs.

12. Device according to claim 5, wherein each said annular jacket is fixed by bonding into a respective one of said first and second housings.

13. Device according to claim 5, wherein each said annular jacket is fixed by wedging into a respective one of said first and second housings.

* * * * *

UNITED STATES PATENT AND TRADEMARK OFFICE

CERTIFICATE OF CORRECTION

PATENT NO. : 6,382,450 B1
DATED : May 7, 2002
INVENTOR(S) : Daniel De Rosa et al.

It is certified that error appears in the above-identified patent and that said Letters Patent is hereby corrected as shown below:

Title page,
Item [73], Assignee, should read as follows:

-- [73] Assignees: G. Pivaudran Developpements, Taverny (FR);
Innovation Packaging, Levallois Perret (FR) --

Signed and Sealed this

Thirteenth Day of May, 2003

JAMES E. ROGAN
*Director of the United States Patent and Trademark Office*